US005959587A

United States Patent [19]

McHenry et al.

[11] Patent Number: 5,959,587

[45] Date of Patent: Sep. 28, 1999

[54] ON THE GLASS ANTENNA SYSTEM

[75] Inventors: Donald L. McHenry, Mount Gilead; Michael L. Bletz, Manfield, both of Ohio

[73] Assignee: PPG Industries Ohio, Inc., Cleveland, Ohio

[21] Appl. No.: 08/928,786

[22] Filed: Sep. 12, 1997

[51] Int. Cl.[6] ..... H01Q 1/32

[52] U.S. Cl. ..... 343/713; 343/704

[58] Field of Search ..... 343/713, 704, 343/906; 439/916; H01Q 1/32

[56] References Cited

U.S. PATENT DOCUMENTS

| | | | |
|---|---|---|---|
| 4,704,592 | 11/1987 | Marth et al. | 336/83 |
| 4,736,206 | 4/1988 | Sakurai et al. | 343/704 |
| 4,779,098 | 10/1988 | Blaese | 343/715 |
| 4,862,183 | 8/1989 | Blaese | 343/715 |
| 4,934,048 | 6/1990 | McElheny et al. | 29/856 |
| 5,099,250 | 3/1992 | Paulus et al. | 343/704 |
| 5,119,106 | 6/1992 | Murakami | 343/713 |
| 5,313,217 | 5/1994 | Kakizawa | 343/713 |
| 5,334,988 | 8/1994 | Murakami et al. | 343/713 |
| 5,355,144 | 10/1994 | Walton et al. | 343/713 |
| 5,581,264 | 12/1996 | Tabata et al. | 343/713 |
| 5,650,791 | 7/1997 | Talty | 343/713 |

FOREIGN PATENT DOCUMENTS

| | | | |
|---|---|---|---|
| 0 297 328 | 1/1989 | European Pat. Off. | H01Q 1/12 |
| 0 355 424 | 2/1990 | European Pat. Off. | H01Q 1/12 |
| 8-97618 | 4/1996 | Japan . | |

OTHER PUBLICATIONS

Fair–Rite Soft Ferrites Brochure, 13th Edition, 1996, pp. 1–6 and 8.

*Primary Examiner*—Hoanganh Le
*Attorney, Agent, or Firm*—Donald C. Lepiane

[57] ABSTRACT

The present invention provides a connector for a glass antenna system having a coil, a first mounting member electrically secured to a first end of the coil, and a second mounting member electrically secured to a second end of the coil. The second mounting member includes an arrangement to permit electrical connection of the connector to a ground. The connector is provided with an arrangement such that the first and second mounting members may be secured to a glass substrate. In one particular embodiment of the invention, the coil is formed from copper wire and includes a ferrite core which extends through the coil. In addition, the first mounting member includes an arrangement to permit electrical connection of the connector to a radio signal receiving device.

26 Claims, 2 Drawing Sheets

ON THE GLASS ANTENNA SYSTEM

BACKGROUND OF THE INVENTION

1. Field of the Invention

This invention relates to a glass antenna system, and more particularly to an antenna system which uses an electrically powered window heater as an antenna element in the system.

2. Technical Considerations

It is well known in the art to provide glass windows in a motor vehicle that incorporate an antenna. In particular, an antenna pattern may be formed from electrically conductive ceramic paints applied and bonded to a surface of the glass window using techniques well known in the art. The window may also include a heater, typically in the form of a heating grid, to defog and/or de-ice the window surface. These grids generally include a pair of opposing electroconductive bus bars and a plurality of electroconductive heating lines which extend between the bus bars along the glass surface. If desired, the heating grid may be coupled to the antenna system to receive radio signals, for example as disclosed in U.S. Pat. Nos. 4,736,206 to Sakurai, et al. and 5,119,106 to Murakami. Coils are typically incorporated into an antenna system which uses the heater grid as part of the antenna to prevent the signal generated in the grid from being lost through a grounded connection. More specifically, coils are generally located between the antenna and the grounded connection to the antenna. For example, U.S. Pat. No. 5,581,264 to Tabata, et al. discloses the use of a choke coil to insulate the defogger system from ground in the broadcast frequency bands and high frequency wave coils to compensate for deteriorated characteristics of the choke coil in the high frequency wave range.

It would be advantageous to integrate more of the antenna system onto the glass so as to reduce costs, simplify the antenna design, and to allow designers to configure other components of the antenna system to be more compact.

SUMMARY OF THE INVENTION

The present invention provides a connector for a glass antenna system, having a coil, a first mounting member electrically secured to a first end of the coil, and a second mounting member electrically secured to a second end of the coil. The second mounting member includes an arrangement to permit electrical connection of the connector to ground. The connector is provided with an arrangement such that the first and second mounting members may be secured to a glass substrate. In one particular embodiment of the invention, the coil is formed from copper wire and includes a ferrite core which extends through the coil. In addition, the first mounting member may include an arrangement to permit electrical connection of the connector to a radio signal receiving device.

The present invention also provides a glass antenna system having a glass substrate, a heater with portions extending along a major surface of the substrate, a first connector secured to a first end of the heater, a second connector secured to a second end of the heater, and a connection to the heater that permits electrical connection of the heater to a radio. The first connector includes a first mount electrically secured to the heater, a second mount secured to the major surface of the substrate at a location spaced from the heater, and a first coil extending between the first and second mounts of the first connector. The second connector includes a first mount electrically secured to the heater, a second mount secured to the major surface of the substrate at a location spaced from the heater, and a second coil extending between the first and second mounts of the second connector. The second mount of the first and second connectors is provided with an arrangement to permit electrical connection of the first and second connectors, respectively, to ground and a power source, respectively. In one particular embodiment of the invention, ferrite cores extend through the first and second coils, a ground cable electrically interconnects the second mount of the first connector to ground, a power cable electrically interconnects the second mount of the second connector to a power source, and a signal cable electrically interconnects the heater to the radio.

DETAIL DESCRIPTION OF THE INVENTION

Figure 1:
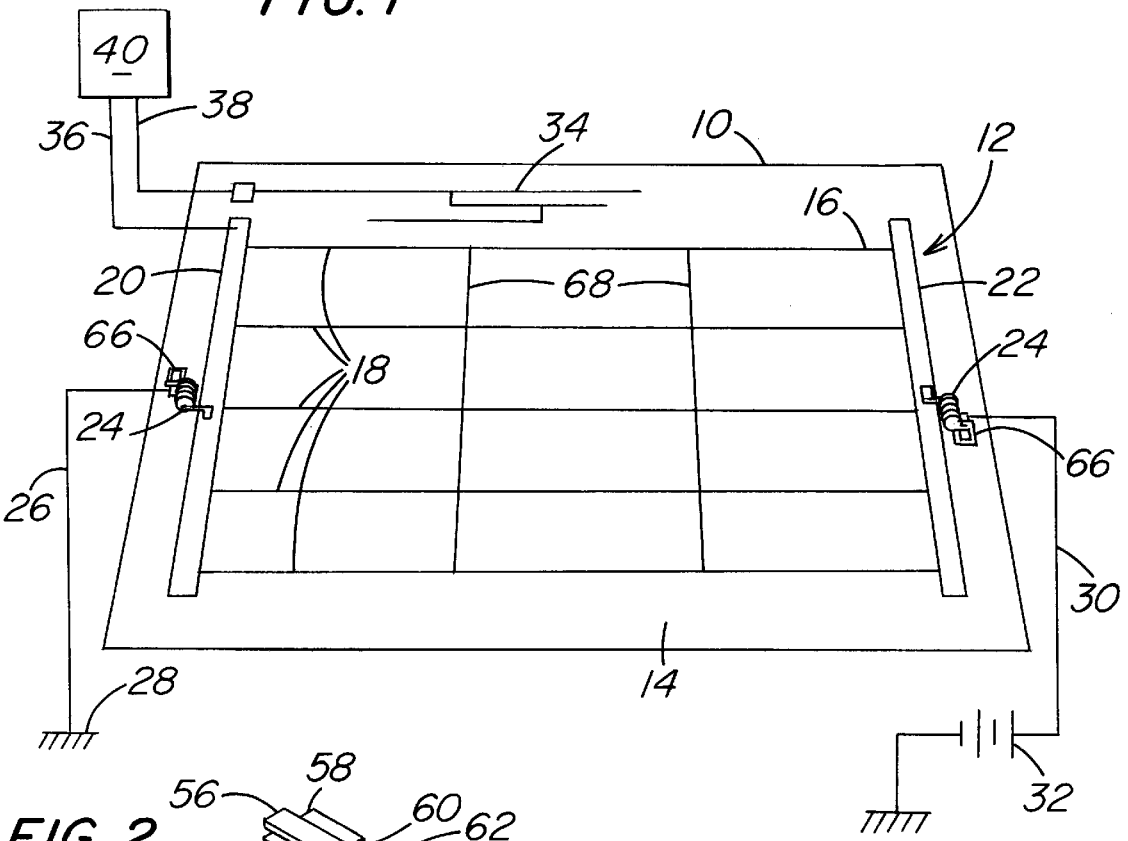
FIG. 1 is a schematic illustration of a glass window with an antenna and heating grid.

FIG. 1 illustrates the basic construction of the glass antenna system of the present invention. Window 10 may be a vehicle window, e.g. an automobile, van, truck, etc., and is provided with a heater system 12 formed on window surface 14 to defog and/or de-ice the window surface. In the particular embodiment illustrated in FIG. 1, heater system 12 includes a grid 16 having a plurality of heating lines 18 extending between a pair of opposing bus bars 20 and 22 positioned along opposing edges of window 10. Heating lines 18 and bus bars 20 and 22 are formed by screen printing silver ceramic paint on surface 14 of window 10 in a desired pattern and heating the glass to cure the paint and bond it to the glass surface 14. Bus bar 20 is connected via a connector 24, which is a subject of the present invention, and ground cable 26 to a ground 28 and bus bar 22 is connected via a second connector 24 and a power cable 30 to a power source 32 which directs electrical energy through the heater system 12. In general, antennas receive multiple radio frequencies but typically each antenna is designed to efficiently receive and direct only selected frequency bands to a receiving device, e.g. a radio. In the particular antenna system illustrated in FIG. 1, the heating grid 16 is designed to receive and direct to FM radio frequencies. Other selected signals, and specifically AM radio frequencies, are received and directed by a separate antenna element. Signal cables direct the signals from each of the antennas to the radio. More particularly, in the antenna illustrated in FIG. 1, AM antenna 34 includes electroconductive elements that are formed from silver ceramic paint screen printed onto surface 14 of the window 10 in a predetermined pattern required to receive the AM radio signals. FM signal cable 36 and AM signal cable 38 are connected to grid 16 and AM antenna 34, respectively, in any convenient manner well known in the art, to deliver the FM and AM signals, respectively, to a radio 40.

It should be appreciated that although the heater and antennas illustrated in FIG. 1 are formed from silver ceramic paints bonded to window surface 14, other types of electroconductive elements may be incorporated into a heater and antenna system of the type disclosed herein. For example, electroconductive wires or transparent electroconductive coatings extending between bus bars may be used as heating elements as well as antenna elements. In addition, the elements may be laminated between two window plies, for example as disclosed in U.S. Pat. No. 5,355,144 to Walton, et al. In such a configuration, arrangements must be provided to access the elements. More particularly and with reference to FIG. 5, there is shown window 200 incorporating features of the invention. The window 200 has a transparent electroconductive coating 204 on window surface 206 electrically interconnecting bus bars 20 and 22.

Connector 24 of the present invention incorporates a coil into the connector design to isolate the antenna signal generated by grid 16. Coils present an impedance to selected radio frequency signals received by the grid 16 and prevent the signals generated therein from going to ground, either directly through a grounded connection or indirectly through the power source 32 as shown in FIG. 1, which would result in a loss of the signal. More specifically and referring to FIGS. 2 and 3, connector 24 includes an electrical coil 42. In order to increase the inductance of coil 42, an iron containing core 44 is positioned to extend through the coil 42, i.e. along its longitudinal axis. Although not limiting in the present invention, it is preferred that the core be ferrite which is a material that exhibits low eddy-current loss at high frequencies. The core 44 is held within the coil 42 by an adhesive 46 (shown only in FIG. 3). End 48 of coil 42 is electrically secured to a first mount 50 in any convenient manner, for example soldering, welding, adhesives. In the particular embodiment shown in FIG. 2, mount 50 is a "Z-shaped" member having a tab 52 electrically secured to end 48 of coil 42 and a base 54 which is secured to surface 14 of window 10, as will be discussed later in more detail. Opposing end 56 of coil 42 is electrically secured to tab 58 of a second mount 60 which further includes a base 62 similar to mount 50. Tab 58 of mount 60 further includes a blade connector 64 to permit electrical connection of the ground cable 26 or power cable 30 (shown in FIG. 1) to the connector 24. Although not required, it is preferred that ends 48 and 56 of coil 42 be flattened to facilitate electrical connection of the coil 42 to the mounts 50 and 60, respectively.

In securing each connector 24 to the window 10, base 54 of mount 50 is electrically interconnected to one of the bus bars 20 or 22 and base 62 of mount 60 is secured to window surface 14. To help facilitate this latter connection, an additional silver ceramic paint area 66 (shown only in FIG. 1) is applied to surface 14 and base 62 is secured to paint area 66. This area 66 may be applied to the glass surface 14 at the same time as the heating grid 16. The mounts 50 and 60 are secured to these portions of the window 10 in any manner well known in the art, for example, soldering or resistance welding.

Figure 2:
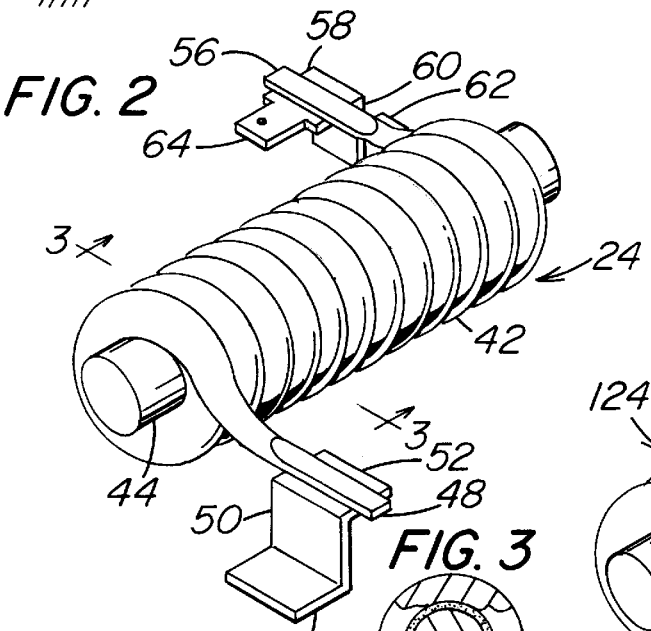
FIG. 2 is an isometric view of the connector of the present invention.
Figure 3:
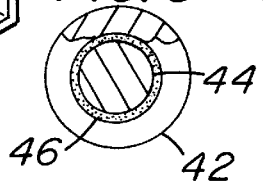
FIG. 3 is a section through line 3—3 of FIG. 2.

Although the embodiment of the connector 24 illustrated in FIG. 2 includes two mounts 50 and 60, it should be appreciated that mount 60 could be eliminated if the coil 42, mount 50 and the connection therebetween was sufficiently strong to secure the connector 24 to the window 10 and allow connection of end 56 of coil 42 to a ground cable 26 or power cable 30. In this connector configuration, end 56 may still include an element similar to blade 64 to accommodate such a connection.

The length and diameter of the coil 42, the number of windings in the coil 42, the type and diameter of the coil wire, and diameter of the core 44 will depend on the desired impedance for the particular radio signal range of interest. Although not limiting in the present invention, in one particular embodiment, coil 42 was used to prevent FM signals from going to ground and was constructed from 12 gauge copper wires having a varnish coating to electrically insulate the wire. The coil 42 had 17 turns of wire and was 37 millimeters (mm) long. The core 44 was a 38 mm by 3.5 mm diameter ferrite rod formed from Fair-Rite 67 material, which is a nickel zinc ferrite material available from Fair-Rite Products Corp., Wallkill, N.Y. The inner diameter of the coil 42 basically matched the diameter of the core 44. Adhesive 46 used to secure core 44 in place within coil 42 was a non-electrically conductive epoxy. Mounts 50 and 60 were both formed from tin plated copper, and solder (not shown) was provided along the bottom surface of bases 54 and 62 of mounts 50 and 60, respectively.

It is preferred that the bottom of the coil 42 be spaced at least 1 mm, and preferably 2 mm, off the glass surface 14 to provide adequate clearance between the coil 42 and glass surface 14 and/or the underlying bus bars 20 and 22. This clearance will prevent potential signal leakage and also prevent tapping of the coil 42 against surface 14 which may result from vehicle vibration. This tapping action may damage the varnish coating on the coil wire which, in turn, may reduce the effectiveness of the connector 24 to prevent radio signals from going to ground.

It should be appreciated that other types of materials may be used to construct connector 24, e.g. copper mounts, aluminum coil wire, an iron core, and further that it is not required for core 44 to be electrically insulated from coil 42. Furthermore, besides sizing the coil 42 and core 44 to prevent selected radio frequencies from going to ground or the power supply, the coil 42 must also be sized to handle the current for the heated window. If the wire diameter is too small for the necessary power consumption, the connector 24 may overheat and fail. In addition, connector mounting techniques, such as resistance soldering, subjects the connector to high temperatures. For these reasons, it is preferred that the coil wire include a high temperature resistant insulating coating to accommodate these types of conditions.

Figure 4:
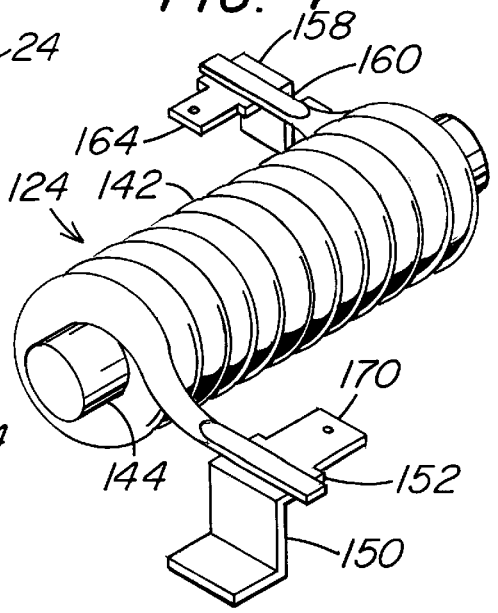
FIG. 4 is an isometric view similar to FIG. 2 of the end of an alternate connector configuration.

FIG. 4 illustrates an alternate embodiment of the connector 24 which may be used to eliminate a separate connection to the heating grid 16 for the antenna system. More specifically, connector 124 includes a coil 142 and ferrite coil 144 similar to the corresponding elements in FIG. 2. Mount 160 includes a tab 158 with a blade connector 164 for connection to a power cable 30 (not shown in FIG. 4) and mount 150 includes a tab 152 and a blade connector 170 for connection to an FM signal coaxial cable 26 (not shown in FIG. 4). With this configuration, connector 124 prevents the radio signal from going to ground and the signal cable directs the radio signal to the radio prior to the signal passing through the coil 142. It is expected that only one connector 124 is required to direct the radio signal to the radio 40; however, it is contemplated that a connector 124 could be positioned on both bus bars of the heater grid 16 with a signal cable connected to each connector 124. Depending on the relative position of the connectors 124 along the opposing bus bars, the two signals directed through the two signal cables may be incorporated into a diversity antenna system of a type well known in the art. In addition, when using connector 124 to connect to the radio, in order to improve signal reception, it is preferred that it be positioned at the end of one of the heater system bus bars. As a result, since the power to the heating grid 16 will be delivered to the end of the bus bar rather than to the center, it may be necessary to modify the configuration of the bus bar in order to properly distribute power along the bus bar to the heater lines 18. For example, the bus bar may be tapered or a metal member, such as a wire braid, may be incorporated into the bus bar to increase its conductivity.

It should be appreciated that FIG. 1 illustrates only one of many different antenna configurations that may incorporate the present invention. For example, rather than separately connecting FM signal cable 36 directly to grid 16 so as to receive the FM signals directly from grid 16, an additional antenna element (not shown) may be positioned on glass surface 14 to extend closely along one of the heating lines 18 of grid 16 such that the antenna element is capacitively coupled to the grid 16 and may receive the radio signals generated by the grid 16. As another alternative, both the AM and FM radio signals may be received through the grid 16. Such a configuration would require at each connection area, a first coil to prevent the FM signals from going to ground, and a second coil connected in series to the first coil, to prevent the AM signals from going to ground. A single signal cable may be used to deliver both the AM and FM signals to the radio. However, it should be appreciated that the coil required to prevent grounding of the AM signal is larger than that required for the FM signal and it may not be desirable to place such a large coil on window 10. In addition, vertical lines 68 may be used to interconnect the heating lines 18 to improve radio signal reception, for example as disclosed in U.S. Pat. No. 5,099,250 to Paulos, et al.

Figure 5:
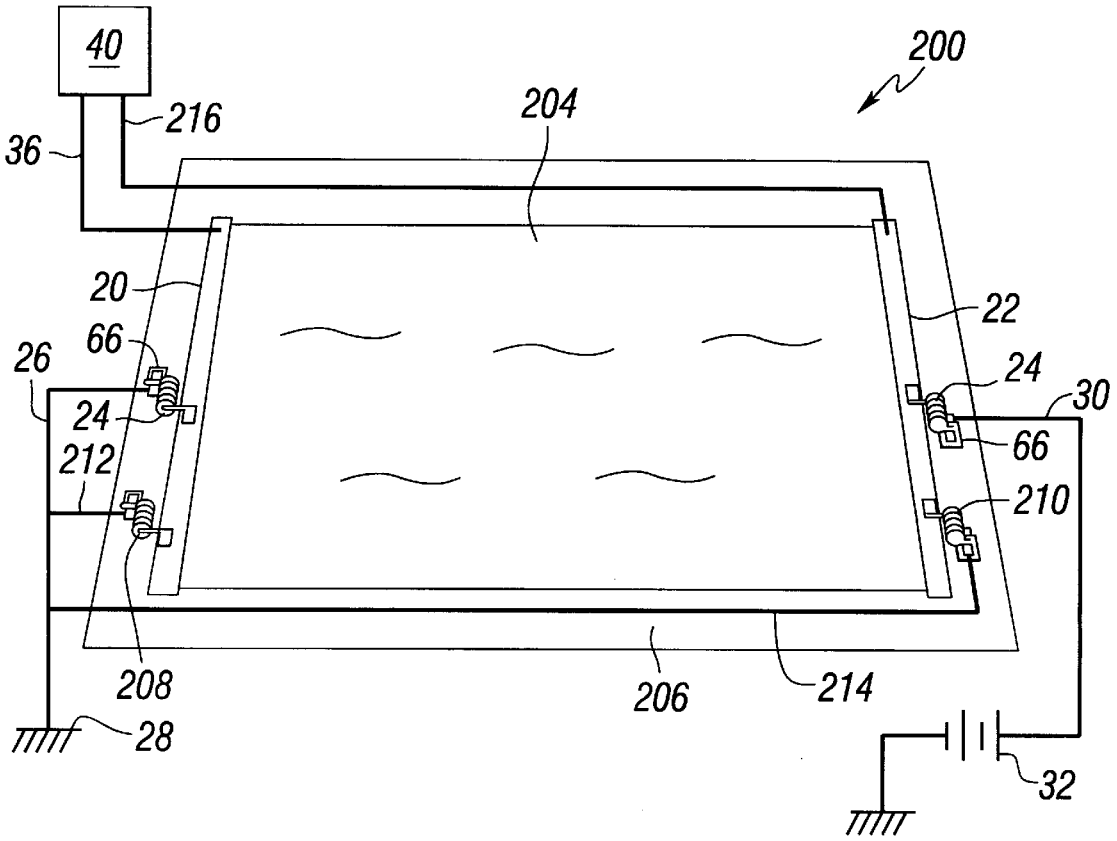
FIG. 5 is a view similar to the view of FIG. 1 illustrating an alternate embodiment of the invention.

More particularly and with reference to FIG. 5, the window 200 includes connectors 208 and 210 similar to the connector 24. The connector 208 has one end connected to the bus bar 20 and the other end connected to the ground 28 in any convenient manner e.g. by way of electrical cables or wires 212 and 26. The connector 210 has one end connected to the bus bar 22 and the other end connected to the ground 28 in any convenient manner e.g. by electrical cables 214 and 28. One or both of the bus bars is connected to the radio in any convenient manner, e.g. as shown in FIG. 5 bus bar 22 is connected to the radio 40 by electrical cable 216, and the bus bar 20 is connected to the radio 40 by electrical cable 36. The coils of the connector 24 prevent FM signals from going to ground and the coils of connectors 208 and 210 prevent the AM signals from going to ground.

The invention described and illustrated herein represents an illustrative preferred embodiment thereof. It is understood that various changes may be made to the connectors and antenna disclosed herein without departing from the scope of the invention as defined by the claims that follow.

We claim:

1. A connector for a glass antenna system, comprising:

an elongated core member;

an electrically conductive conductor wound around and securely mounted to outer surface of said core member, the conductor having one end defined as a first end of the conductor adjacent an end of the core member defined as first end of the core member and opposite end of the conductor defined as a second end of the conductor adjacent opposite end of the core member defined as second end of the core member; and a first mounting member electrically connected to the first end of said conductor spaced from the first and second ends of the core member and a second mounting member electrically connected to the second end of the conductor spaced from the first and second ends of the core member.

2. The connector as in claim 1 wherein said core member contains iron.

3. The connector as in claim 2 wherein said core member is constructed from ferrite.

4. The connector as in claim 3 wherein said electrically conductive conductor is formed from a copper wire.

5. The connector as in claim 4 wherein said wire has an electrically insulating cover.

6. The connector as in claim 4 wherein said first and second ends of said core member are secured to said first and second mounting members, respectively, by welding.

7. The connector as in claim 4 wherein said first and second mounting members further include means to secure said members to a glass substrate.

8. The connector as in claim 1 wherein said first and second mounting members further include means to secure said members to a glass substrate.

9. The connector as in claim 1 wherein said first mounting member further includes means to permit electrical connection of said connector to a radio signal receiving device.

10. A glass antenna system, comprising:

a glass substrate;

a first bus bar mounted on a major surface of the substrate;

a second bus bar mounted on the major surface of the substrate spaced from the first bus bar;

an electrically conductive member interconnecting the first bus bar and the second bus bar;

a first coil having one end electrically connected to the first bus bar and a second end;

a second coil having one end electrically connected to the second bus bar and a second end; wherein at least one of the coils comprises:

an elongated core member;

an electrically conductive conductor wound around and securely mounted to outer surface of said core member, the conductor having one end defined as a first end of the conductor adjacent an end of the core member defined as first end of the core member and opposite end of the conductor defined as a second end of the conductor adjacent opposite end of the core member defined as second end of the core member; and a mounting member connected to the first end of the conductor spaced from the first and second ends of the core member and the second end of the conductor spaced from the first and second ends of the core member where the first end of the conductor is electrically connected to one of the bus bars.

11. The antenna system as in claim 10 wherein the at least one coil is the first coil, said elongated core member of the first coil is an inductance increasing core member and the second coil includes an inductance increasing core.

12. The antenna system as in claim 11 wherein said core member of said first coil is constructed from ferrite.

13. The antenna system as in claim 11 wherein said conductive member includes a transparent heatable electroconductive coating extending between said bus bars.

14. The antenna system as in claim 11 wherein said conductive member is a heating grid extending along said major surface of said substrate and having a plurality of heating lines extending between said first and second bus bars.

15. The antenna system as in claim 10 wherein the at least one coil is the first coil, the elongated core member is first elongated core member, the conductor is a first conductor, the mounting member connected to the first end of the first conductor is electrically connected to the first bus bar and the second coil comprises:

a second elongated core member;

an electrically conductive conductor defined as the second conductor wound around and securely mounted to outer surface of said second core member, the second conductor having one end defined as a first end of the second conductor adjacent an end of the second core member defined as first end of the second core member and opposite end of the second conductor defined as a second end of the second conductor adjacent opposite end of the second core member defined as second end of the second core member; and a mounting member connected to the first end of the second conductor spaced from the first and second ends of the second core member and the second end of the second conductor spaced from the first and second ends of the second core member wherein the first end of the second conductor is electrically connected to the second bus bar.

16. The antenna system as in claim 15 wherein said first and second coils are spaced at least about 1 mm from said major surface of said substrate.

17. The glass antenna system of claim 15 wherein the first bus bar is connected to a signal receiving device; the second end of the first conductor has a mounting member and the second end of the first conductor is connected to a ground, the second end of the second conductor has a mounting member and the second end of the second conductor is connected to a power supply.

18. The antenna system as in claim 17 wherein said signal receiving device is a radio and further including a signal cable interconnects the radio to one of the bus bars.

19. The antenna system as in claim 17 wherein a ground cable electrically interconnects said second end of the first conductor of said first coil to ground, a power cable electrically interconnects said second end of said second conductor of the said second coil to said power supply, said signal receiving device is a radio and a signal cable electrically interconnecting a heatable member to a radio.

20. The antenna system as in claim 19 wherein said first and second coils prevent first selected signals from going to ground and further including (a) a third coil having a first end electrically interconnected to said conductive member, a second end of said third coil secured to said major surface of the substrate at a location spaced from said conductive member, (b) means to permit electrical connection of said second end of said third coil to ground, (c) a fourth coil having a first end electrically connected to the heatable member and the other end of the fourth coil electrically connected to ground, and (d) means provided at said conductive member to permit electrical connection to said radio, wherein said third and fourth coils prevent second selected signals from going to ground.

21. The antenna system as in claim 20 wherein said third coil further includes an inductance increasing core and said fourth coil further includes an inductance increasing core.

22. The antenna system as in claim 20 wherein a ground cable defined as a first ground cable provides electrical interconnection between ground and the first coil, said power cable is a first power cable and interconnects said second coil to the power source, and said signal cable is a first signal cable, and further including a second ground cable electrically interconnecting said second end of said third coil to ground, a third ground cable electrically interconnecting said second end of said fourth coil to ground, and a second signal cable electrically interconnect said heatable member to said radio.

23. The antenna system as in claim 22 wherein said first signal cable is connected to said first end of either said first and second coils and said second signal cable is connected to said first end of either said third and fourth coils.

24. The antenna system as in claim 23 wherein said first signal cable directs FM radio signals to said radio and said second signal cable directs AM radio signals to said radio.

25. The glass antenna system of claim 10 wherein one of the bus bars or the conductive member is connected to a signal receiving device; the second end of the first coil is connected to a ground; the second end of the second coil is electrically connected to a power source and further including a mounting member connected to the second end of the conductor, the second end of the conductor electrically connected to either the electrical ground or power supply.

26. A glass antenna system, comprising:

a glass substrate;

an electroconductive heating grid extending along a major surface of said substrate;

a first connector with a first mount electrically secured to a first end of said heating grid, a first coil with a first end secured to said first mount, and a first ferrite core extending through said first coil;

a first electrically interconnecting member provided at a second end of said first coil;

a second connector with a second mount electrically secured to a second end of said heating grid, a second coil with a first end secured to said second mount, and a second ferrite core extending through said second coil;

a second electrically interconnecting member provided at a second end of said second coil; and a third electrically interconnecting member provided at said heating grid wherein at least one of the coils comprises:

said ferrite core of said at least one coil is an elongated core member;

an electrically conductive conductor wound around and securely mounted to outer surface of said core member, the conductor having one end defined as a first end of the conductor adjacent an end of the core member defined as first end of the core member and opposite end of the conductor defined as a second end of the conductor adjacent opposite end of the core member defined as second end of the core member wherein said first end of the conductor is the first end of the at least one coil and said second end of the conductor is the second end of the at least one coil and the first and second ends of the conductor are spaced from the first and second ends of the core member; and the second end of the conductor of the at least one coil is connected to either an electrical ground or a power supply.

* * * * *